United States Patent [19]

Kono et al.

[11] 3,984,943

[45] Oct. 12, 1976

[54] APPARATUS FOR TREATING SURFACES OF SHEET STEEL OR THE LIKE

[75] Inventors: Yasumasa Kono, Fujisawa; Shuji Miyahara, Yokohama; Susumu Nomura, Yokohama; Hiroyuki Ohkubo, Yokohama; Yoshio Fujimori, Tokyo; Akira Iwawaki; Hiromasa Hirata, both of Yokohama, all of Japan

[73] Assignee: Ishikawajima-Harima Jukogyo Kabushiki Kaisha, Tokyo, Japan

[22] Filed: May 13, 1975

[21] Appl. No.: 577,116

Related U.S. Application Data

[63] Continuation-in-part of Ser. No. 407,071, Oct. 17, 1973, abandoned.

[52] U.S. Cl. ..... 51/8 R; 51/15 R; 51/264

[51] Int. Cl.[2] ..... B24C 3/22; B24C 9/00

[58] Field of Search ..... 51/8 R, 8 BR, 12, 14, 51/15, 264; 29/33 S, 90 A

[56] References Cited

UNITED STATES PATENTS

| | | | |
|---|---|---|---|
| 1,829,599 | 10/1931 | McCrery | 51/8 R |
| 3,104,499 | 9/1963 | Hirons | 51/8 R |
| 3,192,677 | 7/1965 | Johnson | 51/14 X |
| 3,237,351 | 3/1966 | Millhiser | 51/12 X |
| 3,427,763 | 2/1969 | Maasberg | 51/8 R |
| 3,434,241 | 3/1969 | Greenberg | 51/14 |

*Primary Examiner*—Al Lawrence Smith
*Assistant Examiner*—Nicholas P. Godici
*Attorney, Agent, or Firm*—Alfred E. Miller

[57] ABSTRACT

A liquid containing abrasives is projected through nozzles under high pressure upon the surface of an object to be treated such as sheet steel to descale and clean the surface thereof, and the projected abrasive liquid is recovered so that abrasives of suitable particle sizes may be reused. The jet liquid is a mixture of high pressure liquid and slurry abrasives which are substantially uniform in density and granular size. The mixed slurry after projection against the sheet steel workpiece is returned to a vertical style classifier before it settles to the bottom of the collecting tank. The scales which are removed from the sheet steel workpiece are separated out in the classifier while at the same time the density and the granular sizes of the abrasives are made uniform. In addition, the minuscule abrasives are caused to overflow from the classifier while the liquid and the slurry abrasives made uniform in density and granular size are conveyed to the nozzles. The latter are capable of a variety of movements and the workpiece is capable of orientation with respect to the nozzles.

11 Claims, 11 Drawing Figures

APPARATUS FOR TREATING SURFACES OF SHEET STEEL OR THE LIKE

The present invention is a continuation-in-part application of our copending U.S. patent application Ser. No. 407,071 filed Oct. 17, 1973, and now abandoned and relates to a method and apparatus for surfacetreating, that is descaling and cleaning the surface of a sheet steel, a concrete structure or the like by blasting liquid containing abrasives such as sand, chilled-iron globules, aluminum oxide grit or the like.

BACKGROUND OF THE INVENTION

In a conventional apparatus for descaling or cleaning the surface of a steel strip, a storage tank for storing abrasives is connected through a supply line to a nozzle so that abrasives are projected against the surface of a steel strip by either a jet of water or air under high pressure. The abrasive used in this manner are not recovered for reuse. Anticorrosion paint, or the like, is supplied from a storage tank through a jet pump to the nozzle to be projected over the surface of the strip steel. Furthermore, the anticorrosion paint is not collected for reuse.

The above-described conventional apparatus has the following drawbacks:

a. The abrasive supply line tends to be clogged often since the abrasives are supplied to the nozzle by a jet of compressed air or vacuum produced by the injection of water under high pressure. As a result of this arrangement, the descaling or cleaning efficiency is poor and automation is difficult.

b. Since the abrasives are transported by air, heavy and hard particles cannot be used.

c. Since the abrasives and anticorrosion paint are not recovered, the operational cost is very high.

d. When the abrasives are to be recovered, there must be provided a separator, a dryer and associated structure. Therefore, a large space is necessary and the installation cost becomes very expensive.

In the conventional abrasive blasting method in which the operators hold the nozzles and move along a steel strip to descale or clean, many work operations are required and the time required for polishing or cleaning is considerable. Furthermore, the quality of the finished surface is generally poor, especially when the surfaces of a workpiece with a complex structure are finished. Moreover, the time required for finishing each surface is not uniform, and the finished surfaces are not uniform even when finished by skilled workers. Thus, it is difficult to provide the desired uniformly finished surfaces for workpieces.

Furthermore in view of the government requirements regarding protection against health hazards, the conventional abrasive blasting methods are not preferable because when the dry method is used the abrasives are scattered indiscriminately and when the wet method is used, water droplets are scattered indiscriminately. The work efficiency is also considerably reduced.

One of the objects of the present invention is to provide a method and apparatus for abrasive blasting which may prevent the clogging of a supply line.

Another object of the present invention is to provide an abrasive blasting method and apparatus in which abrasive blasting pressure may be arbitrarily selected.

Another object of the present invention is to provide an abrasive blasting method and apparatus in which the used abrasives may be recovered.

A further object of the present invention is to provide an abrasive blasting method and apparatus which may descale or clean the surfaces of an object or work of complex shape in a uniform and efficient manner without causing any health hazards to the workers.

The above and other objects, features and advantages of the present invention will become apparent from the following description of preferred embodiments thereof taken in conjunction with the accompanying drawing in which:

FIG. 1 is a flow sheet of a prior art apparatus for treating the surface of a steel strip or the like;

Figure 3A:
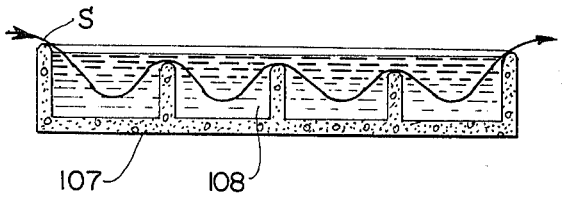
FIG. 3A PRIOR ART
Figure 3B:
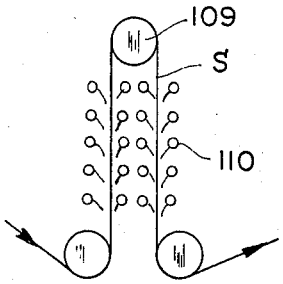
FIG. 3B PRIOR ART
Figure 4:
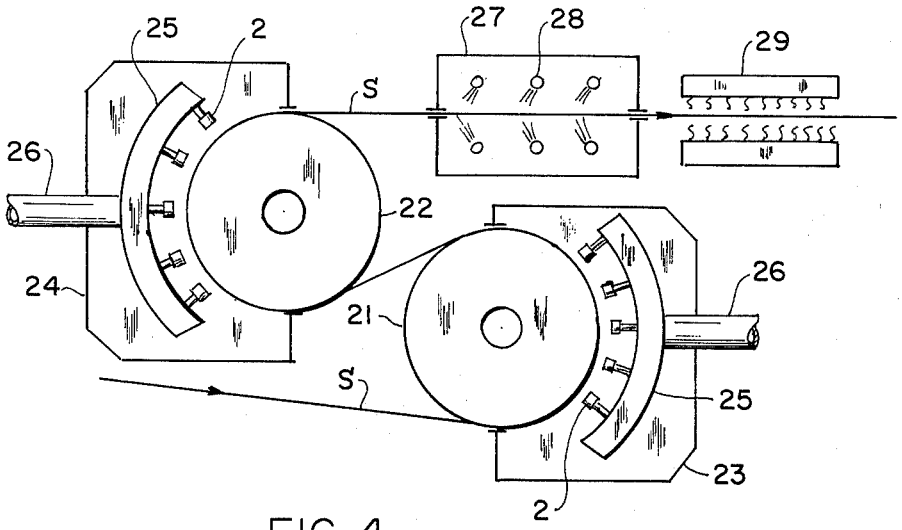
Figure 5:
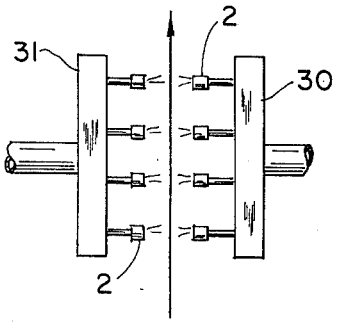
Figure 6:
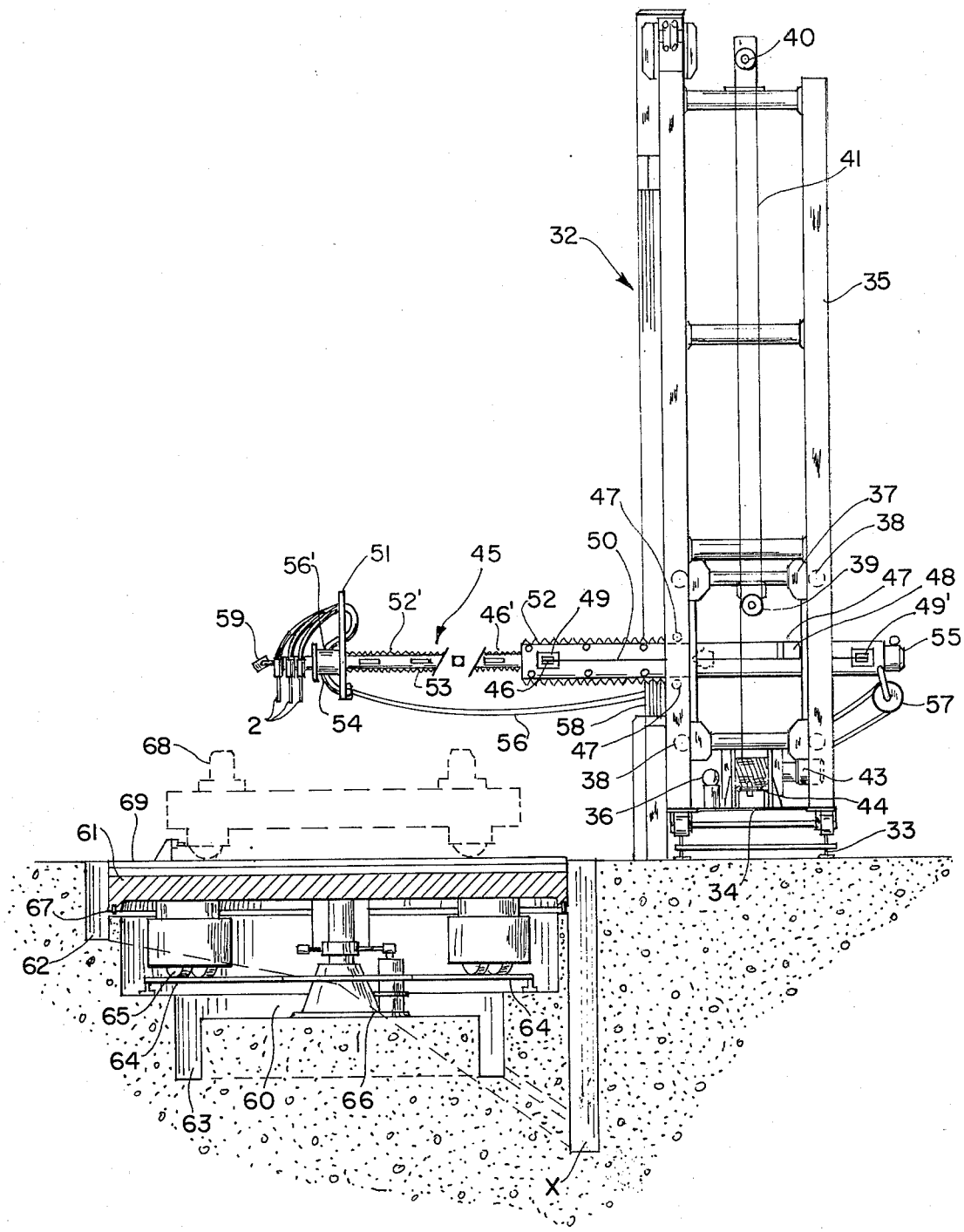
Figure 7:
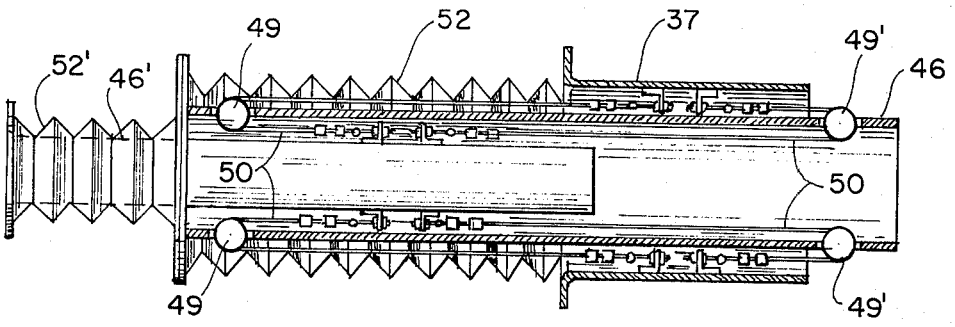
Figure 8:
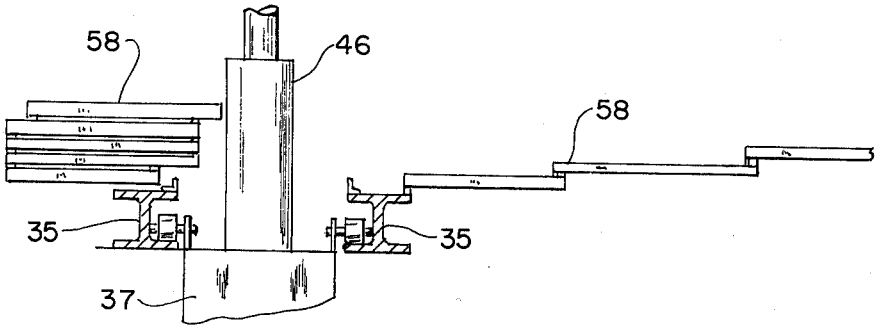
Figure 9:
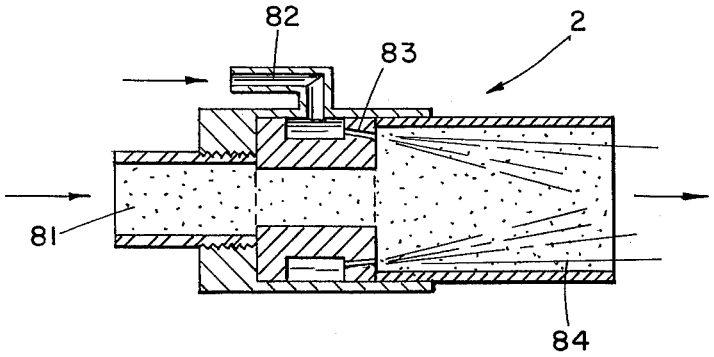
Figure 10:
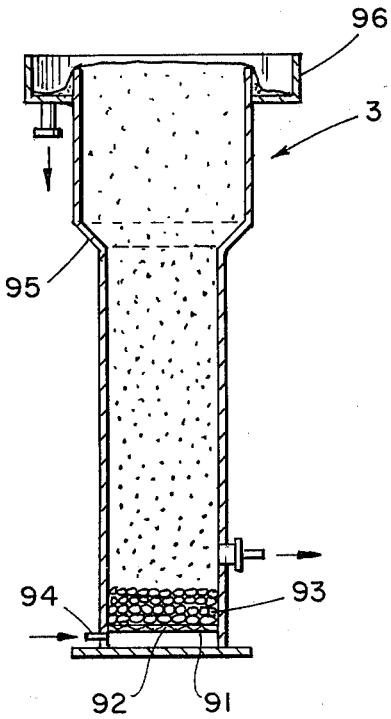

FIGS. 3(A) and 3(B) are schematic views illustrating conventional apparatus for treating the surface of a steel strip or the like;

FIG. 4 is a sectional view of a first embodiment of an apparatus for treating the surface of a steel strip constructed in accordance with the present invention;

FIG. 5 is a schematic side view of a second embodiment of the present invention;

FIG. 6 is an elevational view partly in section of a third embodiment of the present invention;

FIG. 7 is a sectional view of a nozzle boom shown in FIG. 6;

FIG. 8 is a schematic top view illustrating a door of the apparatus shown in FIG. 6;

FIG. 9 is an enlarged sectional view of the nozzle constructed in accordance with the teachings of our invention; and FIG. 10 is a sectional view of the vertical style classifier utilized in the present apparatus.

DESCRIPTION OF THE PREFERRED EMBODIMENTS

Figure 1:
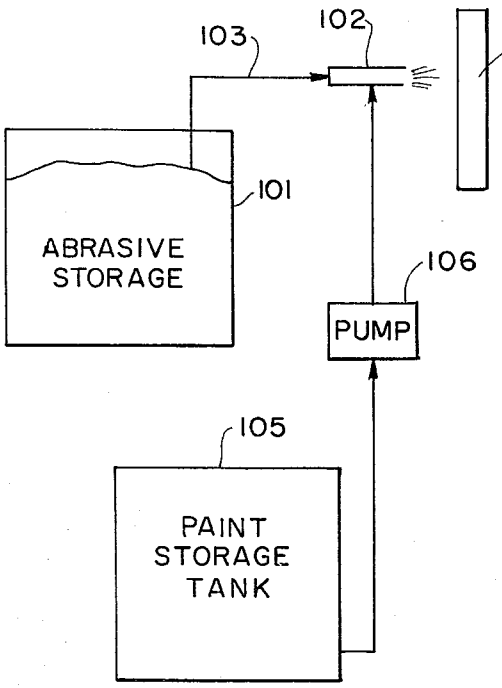
PRIOR ART FIG. 1

Referring to FIG. 1, which is prior art, an apparatus for descaling or cleaning the surface of a workpiece or a steel strip 104 is shown having a storage tank 101 for storing abrasives that is connected through a supply line 103 to the nozzle 102. Thus, the abrasives are propelled against the surface of the steel strip 104, or the like, by means of either a jet of water or high pressure air. The abrasives used in this manner are not recovered for reuse and the anti-corrosion paint is supplied from paint storage tank through a jet pump 106 to the nozzle 102 and thereby projected on to the surface of the steel strip 104.

Figure 2:
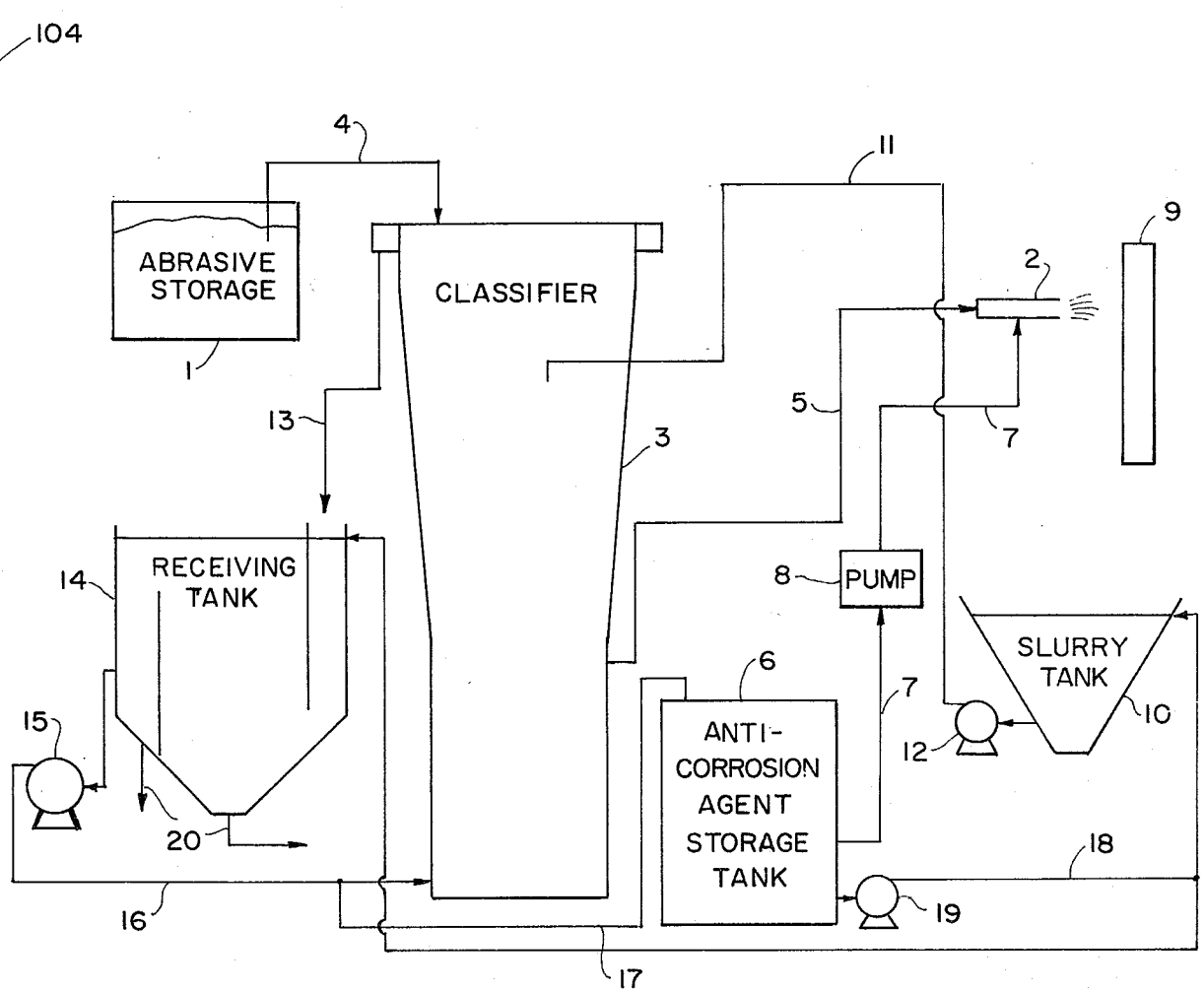
FIG. 2 is a flow sheet of an apparatus for treating the surface of a steel strip of the like incorporating a device for recovering the abrasives constructed in accordance with the present invention.

Referring to FIG. 2, a wet type classifier 3 constructed in accordance with the invention is installed between a storage tank 1 for storing abrasives, such as sand, and a nozzle 2. Abrasives are fed into the classifier 3 through a feed line 4, and abrasives classified by the classifier 3 are supplied to the nozzle 2 through a supply line 5.

The anticorrosion agent stored in a storage tank 6 is fed to the nozzle by a high pressure supply pump 8 through a supply line 7, so that the anticorrosion agent is sprayed together with the abrasives through the nozzle 2 and on to the surface of a steel strip.

The abrasives are classified in the vertical style classifier 3 so that the abrasives of a relatively large particle size are fed in the form of slurry through the supply line 5 to the nozzle 2, and projected on to the surface of the steel strip 9 by a jet of the anticorrosion agent under high pressure supplied from the supply pump 8, so that the surface of the strip steel may be descaled and cleaned.

The abrasives are transported by water flowing from the classifier 3 to the nozzle 2 so that a large quantity of abrasives may be transported as compared with the case in which the abrasives are transported by air flow. Furthermore the clogging of the supply line may be prevented, and the pressure of liquid flowing through the supply line may be arbitrarily selected.

A slurry tank 10 is disposed so as to receive the abrasive liquid after it has been projected over the surface of the strip steel 9, and the slurry received in the slurry tank 10 is returned to the classifier 3 through a slurry return line 11 by a slurry pump 12 before the slurry settles to the bottom of the tank 19. The slurry may be continuously classified by a fluidized bed in the classifier 3. The classified liquid is overflown through an overflow pipe 13 into a tank 14 where the abrasives contained in the slurry are precipitated. The liquid in the tank 14 is returned to the classifier 3 through a return line 16 by a circulation pump 15 so that the slurry in the classifier 3 may be mixed. The liquid from the tank 14 is returned to the anticorrosion agent storage tank 6. In order to maintain a predetermined level in the slurry tank 10 and the receiving tank 14, the anticorrosion agent is fed into them through a feed line 18 from the anticorrosion agent storage tank 6 by a pump 19. Thus, in the slurry tank 10, the abrasive slurry is withdrawn before it settles to the bottom of the tank.

The abrasive liquid projected over the surface of the steel strip 9 drops into the slurry tank 10 and is returned to the classifier 3 through the slurry return line 11 by the slurry pump 12 while it is mixed. The returned slurry is continuously classified in the fluidized bed so that the abrasives of larger particle sizes are separated from the fluidized bed together with the aqueous solution of anticorrosion agent. The high pressure liquid and slurry abrasives made uniform in density and granular size in the classifier 3 are fed to the nozzle through the feed line 5 and projected on to the surface of the steel strip 9.

The particles of smaller sizes entrained by the upward streams in the classifier 3 are fed into the receiving tank 14 through the overflow pipe 13, and are precipitated and separated. The liquid or aqueous solution of anticorrosion agent is returned to the classifier 3 through the supply line 16 and to the anticorrosion storage tank 6 through the return line 17. The particles of smaller sizes precipitated in the receiving tank are discharged through discharge pipes 20.

As seen in FIG. 10, the vertical style wet type classifier referred to generally by the numeral 3 is shown in greater detail. In the lower part thereof a plate 91 is installed which is provided with an opening 92. On the upper surface of the plate 91 are piled in a superposed relation a number of steel balls, gravel or the like to a certain determined height, the granular size being smaller on the top of the pile as compared to the bottom of the pile. The liquid supplied to the apparatus enters the classifier 3 through the nozzle 94 at the bottom thereof, and flows upwardly at a constant speed passing through the steel balls or gravel 93 from the opening 92 in the plate 91. During the process, the abrasives of a certain granular size are prevented from sedimentation by the upstream of the liquid below the tapered portion 95 of the classifier 3, and are distributed evenly in the liquid. However, abrasives of minuscule size, as well as the scale removed from the workpiece are separated out and overflow from the portion of the classifier above the tapered portion 95 to the upper trough 96. The abrasives of minuscule size together with the scales and accompanying liquid then enter the receiving tank 14 shown in FIG. 2.

Referring to FIG. 9, an enlarged view of the nozzle 2 is shown in which the slurry abrasives are supplied to the mixing pipe 84 of the nozzle from the inlet pipe 81. The high pressure liquid is projected into the mixing pipe 84 from the pipe 82 through an annular jet port 83. It will be evident that in the mixing pipe 84 the liquid is mixed with slurry abrasives into the form of a jet liquid which is projected or propelled on to the surfaces of the sheet steel or the like.

Since the abrasive liquid is recovered and reused, the cost of operation of the present apparatus may be considerably reduced. Moreover, since a slurry tank 10 is provided for receiving a slurry mixture after the abrasive liquid is projected against the steel strip 9 it is possible thereby to control the balance of the liquid level of the whole system and thus enlarge the capacity of the present apparatus.

Next, the method and apparatus for treating the surface of a strip steel will be described. A strip steel which is moved along a line may be descaled and cleaned by projecting the abrasive liquid under high pressure through the nozzle as described hereinbefore with reference to FIG. 2.

In general, a coil of steel strip which is supplied to a cold roll mill has been continuously hot rolled and wound into a coil while it was hot. Therefore the large oxide layers are formed upon the surfaces of the steel strip so that they must be completely removed prior to the cold rolling in order to produce the high quality surfaces of a cold rolled steel strip. For this purpose, in the conventional cold roll mills chemical methods for removing the oxide layers are employed. That is in a long pickling line, a steel strip is continuously immersed into hydrogen chloride or sulfuric acid in a large vessel. The steel strip S is passed through pickling agent 108 in a brick vessel 107 as shown in FIG. 3 (A). Alternatively the strip S is passed over a roll 109 and through pickling sprays 110 as shown in FIG. 3(B). Both the pickling apparatus shown in FIGS. 3(A) and 3(B) have the disadvantages that the apparatus is very large and the installation cost is very expensive; that a very expensive acid recovery system must be installed as expensive acids are consumed in large quantity; that waste acids bring about pollution problems and the use of acids cause health hazards; and that the corrosion of the storage vessel presents very serious problems. According to the present invention, however, these and other drawbacks may be substantially eliminated as will be described in detail hereinafter.

In the embodiment shown in FIG. 4, prior to the continuous cold rolling operation, a steel strip S is wrapped around rolls 21 and 22 in the form of an S so that the abrasive liquid is projected upon the surfaces of the steel strip S through arcuately disposed nozzles 2 extending from headers 25 in cleaning chambers 23 and 24. The abrasive liquid is fed into the heads 25 through pipes 26. As described hereinbefore with reference to FIG. 2, the abrasive liquid or slurry is projected through the nozzles 2 at high speeds and under high pressure.

Scales on one surface of the strip steel S are removed by the abrasive liquid projected through the nozzles 2 in the cleaning chamber 23, and the anticorrosion agent is applied to one surface. Since the cleaning chamber 23 is filled with inert gas, the reoxidation of the cleaned surface may be prevented. Thereafter, the steel strip S is advanced into the next cleaning chamber 24 where scales on the other surface of the strip S are removed by the abrasive liquid propelled through the nozzles 2.

The rolls 21 and 22 in the cleaning chambers 23 and 24 serve not only to advance the strip S but also to receive the high hydrostatic pressure of abrasive liquid, thereby preventing the vibrations of the strip S and maintaining a predetermined distance between the strip and the nozzles 2.

The abrasives are projected by a jet of water under high pressure of about 50 $Kg/cm^2$ or one thousand kilograms per square centimeter. The pressure may be arbitrarily selected depending upon scales to be removed on the surfaces of the strip.

The nozzles are so arranged that the abrasive liquid is projected against the surface of the strip substantially in the same direction on a line tangent to the roll 21 or 22 so that the removal of scales may be removed in an efficient manner.

The abrasive liquid projected upon the surfaces of the strip S through the nozzles is recovered in the slurry tank 10 shown in FIG. 2 and returned to the wet type classifier 3 through the slurry return line 11. The returned abrasive liquid is continuously classified in the classifier 3 so that the abrasives of larger particles sizes may be used again. The liquid containing particles of smaller sizes overflows through the overflow pipe 13 of the classifier 3 into the tank 14, and the liquid free from the particles is returned not only to the classifier 3 through the return line 16 but also to the anticorrosion agent storage tank 6 through the return line 17. In the manner described above the projected abrasive liquid is recovered and the abrasives of larger particle sizes and the liquid containing the anticorrosion agent are used again in the present apparatus. The abrasives may be replenished through the feed line into the classifier 3.

Referring now to FIG. 4, the downstream of the cleaning chamber 24, there is installed a washing chamber 27 in which nozzles 28 for spraying cleaning water and a drying chamber 29 are utilized so that the after-treatment of the strip may be effected. In the cleaning chamber 27 foreign matter on the surfaces of the strip S may be washed off by cleaning water projected through the nozzles 28 or by brushes (not shown), and thereafter the strip is dried before it is fed into a cold rolling mill. When the strip is immediately fed into the cold roll mill after it has been descaled and cleaned by the abrasive liquid, cleaned by clean water and dried, it is not necessary to apply oil to the surfaces of the strip in order to prevent the oxidation. Cleaning water may be supplied to the cleaning chamber 27 from an independent cleaning water supply device (not shown) or may be the liquid recovered from the chambers 23 and 24.

In the second embodiment shown in FIG. 5, the strip S is advanced along a straight path and spaced apart from the nozzles 2 by a predetermined distance. The abrasive liquid is supplied through headers 30 and 31 and projected through the nozzles 2 onto the surfaces of the strip S. Furthermore, in the situation when a coil strip is supplied to a cold roll mill, the coils must frequently be replaced with new coils. This procedure often is necessitated during the rolling operation with the result of the complete suspension of operations. Therefore, it is not possible to install the conventional continuous type of pickling line on the input side of a cold rolling mill. However, because of the present scale removing apparatus, it is possible to adjust the quantity of abrasives supplied to the nozzle and to completely terminate the slurry abrasives discharged from the nozzle during the line suspension. Moreover, it is also possible to change the direction of the nozzle in order to keep the slurry away from the strip surface. Accordingly, the combination of the present scale removing apparatus with the cold rolling mill makes it possible to save a great deal of energy as well as to reduce costs.

Another embodiment of the invention shown in FIGS. 6, 7 and 8 is the construction and arrangement in which both the nozzles 2 and an object such as sheet steel are moved, and the used abrasive liquid is collected in one location.

A frame 35 of a predetermined height is mounted upon a motor-driven carriage 34 which rides upon rails 33 laid on the foundation and is driven by a motor 36. A gondola 37 provided with four guide rolls 38 is vertically movably-mounted upon the frame 35. A rope 41 having one end securely fixed to a drum 44 of a winch mounted upon the carriage 34 and the other end wrapped around an upper pulley 40 fixed to the top of the frame 35, a pulley 39 fixed to the gondola 37 and the upper pulley 40 again, and the other end of the rope 41 is fixed to the gondola 37, whereby the gondola 37 may be vertically moved as the rope 41 is wound around the drum 44 of the winch 43. One end portion of a nozzle boom assembly 45 comprising a first boom 46 and a second boom 46' telescopically fitted into the first boom 46 which is horizontally slidably mounted upon the gondola 37 along guide rollers 47, and the nozzle boom assembly 45 is moved by a motor 48 mounted upon the gondola 37.

Referring to FIG. 7 the construction of the nozzle boom assembly 45 will be described in more detail hereinafter. Pulleys 49 and 49' are fixed to the front and rear ends of the first boom 46, and ropes 50 whose one ends are securely fixed to the gondola 37 are wrapped around the pulleys 49 and 49', respectively, and are passed through the first boom 46 and then fixed at the other ends to the second boom 46'. Therefore when the first boom 46 is moved forwardly or backwardly, the second boom 46' is extended out or withdrawn into the first boom 46. The first and second booms 46 and 46' are surrounded by bellows 52 and 52', respectively, so that they may be free from the abrasives. More particularly, the bellows 52 has its ends fixed to the frame 35 and the leading end of the first boom 46, respectively, and the bellows 52' has its ends fixed to the leading ends of the first and second booms 46 and 46', respectively. Therefore the bellows 52 and 52' may be expanded and contracted as the nozzle boom assembly 45 is extended and retracted.

Referring again to FIG. 6, a nozzle assembly 54 is shown comprising a plurality of nozzles 2, only three of which being illustrated, which are attached to the leading end of the second boom 46'. More particularly, the nozzles 2 are fixed to the extension beyond the leading end of the second boom 46' of a flexible pipe 53 which is extended through the nozzle boom assembly 45 and whose rear end is coupled to a motor 55 mounted upon the first boom 46. Therefore, the flexible pipe 53 is rotated about its axis by the motor 55, whereby the nozzle assembly 54 may be rotated through the axis of the pipe 53. Thus, the angle of the nozzles 2 with respect to an object to be treated may be aribtrarily and selectively varied.

A hose 56 whose one end is hydraulically coupled to a high pressure pump (not shown) is wrapped around a drum 57 fixed to the first boom 46 and has its other end fixed to a manifold 51 attached to the leading end of the second boom 46'. The nozzles 2 communicate hydraulically with the manifold 51. Therefore, the abrasive liquid is forced through the hoses 56 and 56' and projected through the nozzles 2.

As shown in FIG. 8, a collapsible door consisting of a plurality of members 58, only five of which are shown, is fixed to each side of the frame 35. For example, the free end of the collapsible door 58 may be fixed to the factory so that the door 58 may be extended and retracted as the frame 35 is moved. Therefore, the projected abrasive liquid may be prevented from being adhered to the driving arrangement, including the carriage motor, the winch, the high pressure pump, etc. Furthermore, by extending the collapsible door 58, as shown in FIG. 8, the end of the side opposite to the side fixed to the frame 35 of the door is secured to a wall or other suitable stationary structure of a factory. In this manner, the slurry mixture composed of liquid and slurry abrasive can be prevented from being splashed to the side of the gondola 37 or drum 35.

It will be observed that an illumination lamp 56 is fixed to the leading end of the nozzle assembly.

As seen in FIG. 6, a round pit 60 is formed in the foundation and is surrounded by an annular outer ditch 62 whose bottom is gradually sloped to the deepest point indicated by X. An annular inner ditch 63 which is formed in the bottom of the pit 60 is communicated with the outer annular ditch 62 as indicated by the broken lines. Guide rollers 65 of a turntable 61 disposed within the pit 60 ride on an annular rail 64 so that the turntable 61 is rotated upon the annular rail 64 by a drive unit 66. Water-proof sealing members 67 are interposed between the underside periphery of the turntable 61 and the inner wall of the outer annular ditch 62. Upon the turntable 61 are laid rails 69 upon which rides a carriage 68. Rails (not shown) with the same gauge as that of the rails 69 are laid upon the foundation so that when the rails on the turntable and one foundation are aligned with each other, the carriage 68 may be transferred onto the rails on the foundation.

Referring to FIG. 2, the slurry abrasives which have been made uniform as to density and granular size in the vertical style classifier 3 are fed into the supply line 5 at a point on the classifier between the top and bottom ends thereof, and at a relatively low pressure. The abrasives go directly to the nozzle 2 where they mix with the high pressure liquid being propelled into the nozzle head 84 through the inlet 83 and the mixture is brought up to pressure by a Venturi effect.

The mode of operation of the present invention is as follows:

An object such as sheet steel to be treated is placed on the carriage 68. As described hereinbefore, the positions and angles of the nozzles 2 with respect to the sheet steel may be varied selectively and arbitrarily. That is, the vertical position of the nozzle assembly 54 may be adjusted by vertically moving the gondola 37 by winding or letting out the wire rope 41 on the winch 43. Since the nozzle boom 45 is carried by the gondola 37, the nozzle boom 45 and hence the nozzle assembly 54 is vertically moved as the gondola 37 is vertically moved along the frame 35. The horizontal position of the nozzle assembly 54 in the direction perpendicular to the nozzle boom 45 may be adjusted by moving the carriage 34, which is driven by the motor 36, along the rails 33. The position of the nozzle assembly 54 in the axial direction of the nozzle boom 45 may be adjusted by driving the motor 48. That is, when the first boom 46 of the nozzle boom 45 is extended or retracted by the motor 48, the second boom 46' is extended out of or retracted into the first boom 46 in the manner described hereinbefore so that nozzle boom 45 and hence the nozzle assembly 54 may be extended out of or retracted into the gondola 37. The projection angle of the nozzle assembly 54 may be adjusted by driving motor 55 that rotates the flexible pipe 53 carrying the nozzle assembly 54 at its leading end.

Thus, the nozzle assembly 54 may be horizontally and vertically moved with respect to the sheet steel upon the carriage 68 as the descaling and cleaning operation proceeds, and the projection angle of the nozzle assembly 54 may be adjusted and controlled in a suitable manner. Therefore, an object of any shape may be uniformly descaled and cleaned.

The abrasive liquid propelled on to the workpiece is collected into the outer ditch 62 and flows down to the deepest portion X, but is prevented by the sealing members 67 from entering into the pit 60. If any abrasive liquid should enter into the pit 60, it is collected into the annular ditch 63 and flows down to the deepest portion X of the outer ditch 62. The abrasive liquid flows from the deepest portion X to the recovery device shown in FIG. 2. The recovered abrasive liquid is introduced into the classifier 3 through the line 11 and recirculated in the manner described hereinbefore with reference to FIG. 2.

It is to be understood that the present invention is not limited to the embodiments thereof described hereinabove with reference to the accompanying drawing, and that various modifications may be effected without departing the true spirit of the present invention. For example the flow rate of the liquid flowing upwardly and the position of the discharge port from the fluidized bed in the classifier 3 may be arbitrarily selected so that the abrasives of particle sizes best adapted for the surface treatment of an object may be recovered. The liquid which carries the abrasives is not limited, and it may be water or an aqueous solution of anticorrosion agents. In addition to the cleaning and drying devices 27 and 29 shown in FIG. 4, any device or apparatus required for the after-treatment may be used.

The advantages of the construction and arrangement of the present invention may be summarized as follows:

1. Since the abrasives are carried by liquid under high pressure the supply line to the nozzles may be prevented from being clogged so that an uninterrupted supply may be ensured.

2. Because of the injection effect present at the nozzles and the head of the wet type classifier, the abrasive liquid may be uniformly projected under high pressure.

3. Since a wet type classifer is used, the classification of abrasives is very efficient and effective. They may be classified continuously, and the pressure under which they are projected may be arbitrarily varied by varying the head of the classifier.

4. Since an abrasive liquid recovery device is incorporated in the arrangement, the abrasives and anticorrosion agent may be circulated. As a result a significant economy of the use of abrasives and anticorrosion agent may be attained, and the discharge of waste and sludge may be reduced.

5. There is no pollution problem.

6. In case of a strip metal, the overall length of the production line may be made short so that the apparatus may be designed to be compact in size and the installation cost may be remarkably reduced. In contradistinction to the conventional pickling methods, the production line may be suspended only by interrupting the projection of the abrasive liquid, and the pattern of the projection of the abrasive liquid may be arbitrarily varied depending upon the line speed. Thus, the operation is simple and safe.

7. Since no acid is used, the corrosion problem is virtually eliminated. The operation of the apparatus is highly reliable, and the hydraulic system may be designed in a simple manner because no chemical agent is utilized and because only water is used.

8. The nozzle assembly may be horizontally and vertically movable in three directions perpendicular to each other, and the projection angle of the nozzle assembly may be arbitrarily varied. Therefore, the uniform surface treatment of not only sheet metal but also an object of complex shape may be carried out in an efficient manner.

9. An object to be treated is placed upon the turntable and the position and projection angle of the nozzle assembly may be adjusted, as described above, so that even a large sized object may be treated within a short time, and the quality of the treated surfaces is excellent.

10. The treatment time of the similar surfaces of objects of complex shape is uniform, and the quality of finished surfaces is also uniform.

11. The work efficiency is remarkably increased, and there is no problem of causing health hazards as in conventional methods.

12. The used abrasive liquid is collected in a predetermined location within the pit so that the recovery may be much facilitated.

13. The quality of the surfaces may be suitably controlled by the after-treatment devices.

14. The abrasive blasting apparatus constructed in accordance with the present invention may be advantageously incorporated with the cold rolling mill so that the cleaned strip steel may be directly supplied into the cold rolling mill.

What is claimed is:

1. An apparatus for continuously descaling at least one surface of an elongated object such as sheet steel or the like comprising: a nozzle for a slurry mixture including abrasive particles, a slurry tank for collecting said slurry mixture projected onto a surface of said elongated object, a vertically disposed wet type classifier operatively connected to said slurry tank and receiving said slurry mixture for classifying as to density and granular size, a receiving tank for collecting miniscule abrasives and the removed scales from the liquid overflowed from said classifier, a plurality of superposed elements in the lower portion of said classifier, means for supplying liquid to said classifier for upward flow at a constant speed through said superposed elements whereby the abrasive particles of a certain size are distributed uniformly in said liquid to form said slurry abrasives, and the miniscule abrasives and scale removed from the workpiece overflowing from said classifier to said receiving tank causing said miniscule abrasives and said scale to be separated out of said classifier, said nozzle accomodating a mixture of high pressure liquid and slurry abrasives which has been made uniform as to density and granular size to form said slurry mixture, a conduit arrangement for conducting said slurry abrasives at a relatively low pressure from said classifier at a point intermediate to its ends to said nozzle, and a high pressure pump operatively connected to said conduit arrangement whereby said high pressure liquid mixes with said slurry abrasives of uniform granular size which is supplied to said nozzle.

2. An apparatus as claimed in claim 1, wherein said superposed elements are steel balls.

3. An apparatus as claimed in claim 1, wherein the elements on the top of the superposed pile are of smaller cross-section than the elements on the bottom of said pile.

4. A movable apparatus for continuously treating at least one surface of an object, such as sheet steel or the like, comprising: a vertical style wet type classifier provided with abrasive particles in the form of a liquid slurry, a receiving tank for collecting miniscule abrasives and the removed scales from the liquid overflowed from said classifier, at least one nozzle through which said abrasive particles pass, the abrasive particles and the scale removed from the treated object are returned to the classifier a plurality of superposed elements in the lower portion of said classifier, means for supplying liquid to said classifier for upward flow at a constant speed through said superposed elements whereby the abrasive particles of a certain size are distributed uniformly in said liquid to form said slurry abrasives, and the miniscule abrasives and scale removed from the workpiece overflowing from said classifier to said receiving tank causing said miniscule abrasives and said scale to be separated out of said classifier, a first conduit means for conducting the abrasives in said classifier which are substantially uniform in density and granular size to said nozzle, means including a second conduit provided with high pressure liquid mixing with said liquid slurry containing said abrasive particles in said nozzle for projecting the slurry with said abrasive particles under high pressure through said nozzle and against said object to be treated, and a slurry tank for collecting the slurry after being projected against said object and returning said slurry to said classifier.

5. An apparatus as claimed in claim 4 further comprising a tank, a pump and a supply line for conducting an anti-corrosion agent in said tank to said nozzle whereby said anti-corrosion agent is sprayed together with said liquid slurry against said object to be treated.

6. An apparatus for continuously treating at least one surface of a hot-rolled steel strip before being supplied to a cold rolling mill comprising: a nozzle for a slurry mixture including abrasive particles, a slurry tank for collecting said slurry mixture projected onto a surface of said elongated object, a vertically disposed wet-type classifier operatively connected to said slurry tank and receiving said slurry mixture for classifying as to density and granular size, a receiving tank for collecting miniscule abrasives and the removed scales from the liquid overflowed from said classifier, a plurality of superposed elements in the lower portion of said classifier, means for supplying liquid to said classifier for upward flow at a constant speed through said superposed elements whereby the abrasive particles of a certain size are distributed uniformly in said liquid to form said slurry abrasives, and the miniscule abrasives and scale removed from the workpiece overflowing from said classifier to said receiving tank causing said miniscule abrasives and said scale to be separated out of said classifier, said nozzle accommodating a mixture of high pressure liquid and slurry abrasive particles which has been made uniform as to density and granular size to form said slurry mixture, a conduit arrangement for conducting said slurry abrasives at a relatively low pressure from said classifier at a point intermediate to its ends to said nozzle, and a high pressure pump operatively connected to said conduit arrangement whereby said high pressure liquid mixes with said slurry abrasives of uniform granular size which is supplied to said nozzle; and after treatment means for conditioning the treated strip of said hot-rolled steel strip.

7. An apparatus as claimed in claim 6, wherein said last mentioned means is a washing chamber and a drying chamber.

8. An apparatus as claimed in claim 7, wherein said strip surface treating apparatus and said after treatment means are located adjacent to the input of said cold rolling mill.

9. An apparatus for treating at least one surface of an elongated object such as sheet steel or the like comprising: a wet-type classifier provided with abrasive particles, a plurality of nozzles, a supply line for conducting said abrasive particles from said classifier in the form of a liquid slurry to said nozzles, means co-acting with said liquid slurry containing said abrasive particles for projecting the latter under high pressure through said nozzles and against said object to be treated, means for collecting the slurry after being projected against said object and returning said slurry to said classifier, a movable support, a nozzle boom mounting said plurality of nozzles, said support being movable selectively substantially horizontally or substantially vertically, said nozzle boom having telescoping sections, the assembly of said plurality of nozzles being mounted on the free end of said nozzle boom, each of said nozzles being adapted to project liquid containing abrasive particles against said object to be treated, a pit positioned adjacent to said movable support provided with an annular ditch having a bottom which is inclined, means connected to the deepest part of the bottom of said ditch for recovering the projected liquid containing abrasive particles, and a rotatable turntable in said pit upon which said object to be treated is placed.

10. An apparatus as claimed in claim 9, wherein said nozzle boom is capable of rotation to vary thereby the projection angle of the nozzles relative to the object to be treated.

11. An apparatus as claimed in claim 10, wherein said means for rotating said nozzle boom is a motor mounted on one of the telescoping sections of said boom.

* * * * *